US007261586B2

(12) United States Patent
Cramer

(10) Patent No.: US 7,261,586 B2
(45) Date of Patent: Aug. 28, 2007

(54) CORD SLEEVE, AND DEVICE PROVIDED THEREWITH

(75) Inventor: Christoph Cramer, Aichtal (DE)

(73) Assignee: Robert Bosch GmbH, Stuttgart (DE)

( * ) Notice: Subject to any disclaimer, the term of this patent is extended or adjusted under 35 U.S.C. 154(b) by 107 days.

(21) Appl. No.: 11/226,879

(22) Filed: Sep. 14, 2005

(65) Prior Publication Data

US 2006/0065562 A1 Mar. 30, 2006

(30) Foreign Application Priority Data

Sep. 28, 2004 (DE) ..... 10 2004 046 905

(51) Int. Cl.
*H01R 13/50* (2006.01)

(52) U.S. Cl. ..... 439/447; 439/577; 439/491; 206/349; 173/2; 173/20; 173/171; 173/217

(58) Field of Classification Search ..... 439/577, 439/491, 445–448, 488; 173/2, 20, 171, 173/217; 206/349; 340/568.3
See application file for complete search history.

(56) References Cited

U.S. PATENT DOCUMENTS 5,092,793 A * 3/1992 Stephan ..... 439/446
5,334,044 A 8/1994 Falossi et al. ..... 439/491
6,018,227 A * 1/2000 Kumar et al. ..... 320/106
6,050,847 A * 4/2000 Kawakami et al. ..... 439/447
6,509,555 B1 * 1/2003 Riess et al. ..... 219/633
6,536,536 B1 * 3/2003 Gass et al. ..... 173/2
2007/0032127 A1 * 2/2007 Sheppard ..... 439/502

FOREIGN PATENT DOCUMENTS

| | | |
|---|---|---|
| FR | 1 321 537 | 2/1962 |
| GB | 1 115 332 | 5/1968 |
| GB | 2 298 972 | 9/1996 |
| JP | 10-289627 | 10/1998 |
| JP | 2003-203527 | 7/2003 |

* cited by examiner

*Primary Examiner*—Gary F. Paumen
(74) *Attorney, Agent, or Firm*—Michael J. Striker

(57) ABSTRACT

An electric hand power tool has a housing, a drive motor, a power cord extending to an outside from the housing and supplying energy to the drive motor, wherein the power cord has an exit region with a cord sleeve that tubularly clasps the power cord and is provided with a structure for receiving a data storage medium.

15 Claims, 2 Drawing Sheets

CORD SLEEVE, AND DEVICE PROVIDED THEREWITH

CROSS-REFERENCE

The invention described and claimed hereinbelow is also described in DE 10 2004 046 905.9, filed Sep. 28, 2004. This German Patent Application, whose subject matter is incorporated here by reference, provides the basis for a claim of priority of invention under 35 U.S.C. 119 (a)-(d).

BACKGROUND OF THE INVENTION

The present invention relates to a cord sleeve, as well as to a device provided therewith, such as for example an electric hand power tool.

Various cord sleeves are known that all have the object of protecting power cords that emerge to the outside from equipment housings against cord breakage in the region of the exit point by absorbing bending moments that occur in this region and preventing the cord from kinking sharply in that region. Until now, these cord sleeves were hardly suitable for receiving data storage media inconspicuously in the manner of a pocket in such a way that they are protected from view and touch from outside and from being lost.

SUMMARY OF THE INVENTION

Accordingly, it is an object of the present invention to provide a cord sleeve and a device provided therewith, which avoids the disadvantages of the prior art.

In keeping with these objects and with others which will become apparent hereinafter, one feature of the present invention resides, briefly stated, in a cord sleeve for a device in particular an electric hand power tool, provided with a power cord that extends to an outside, in which the cord sleeve comprises a cord element connectable with the power cord, and means is provided for receiving a data storage medium in said cord sleeve element.

Another feature of the present invention resides, briefly stated, in a an electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium.

When the cord sleeve, and the electric hand power tool with the cord sleeve are designed in accordance with the present invention, the advantage is provided that a cord sleeve has been created which receives a data storage medium in a way that is invisible from outside and is protected against being removed unintentionally from outside and is captive. The data storage medium can be designed as an anti-theft device that communicates with external sensors and signal equipment.

Because the data storage medium is seated in a cord sleeve in a way that it cannot be seen, especially from outside, it cannot be perceived from outside or removed unintentionally.

Because once the cord sleeve has been installed on the housing, the data storage medium cannot easily be removed from the cord sleeve, effective protection against unintentional removal of the data storage medium is created.

Because the cord sleeve has a pocket of slotlike cross section that is accessible from its front end and that extends parallel to the power cord, and the data storage medium can be placed in the cord sleeve in captive fashion before the cord sleeve is installed on the electric hand power tool, its installation is accomplished quickly and simply, and its preservation is secure.

Because the data storage medium can be held firmly in the pocket in force- and/or form-locking fashion, it cannot be lost even before the cord sleeve is installed.

Because the cord sleeve comprises or contains a material in which—in a way that cannot be seen from outside—data can be stored and rewritten magnetically or thermally or the like, the cord sleeve itself acts as a data storage medium.

Because the cord sleeve has a radial basket-shaped bulge that serves as a pocket for stowing the data storage medium, it is possible with only slight changes in construction for the previous injection mold or the like, for producing the previous cord sleeve, to be used again for producing the novel cord sleeve.

Because the data storage medium is elastically bendable, it can, without destruction, withstand even major deformations of the cord sleeve or cord in the region of its exit point from the housing.

Because the data storage medium is integrated with the cord sleeve, it can be written or equipped with suitably variable information even after the device has been fully assembled.

Because surface adhesive means, such as adhesives or hook-and-loop closure systems, are located in the interior of the pocket and firmly hold the data storage medium detachably in it, the data storage medium cannot be detached unintentionally from the cord sleeve.

The novel features which are considered as characteristic for the present invention are set forth in particular in the appended claims. the invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
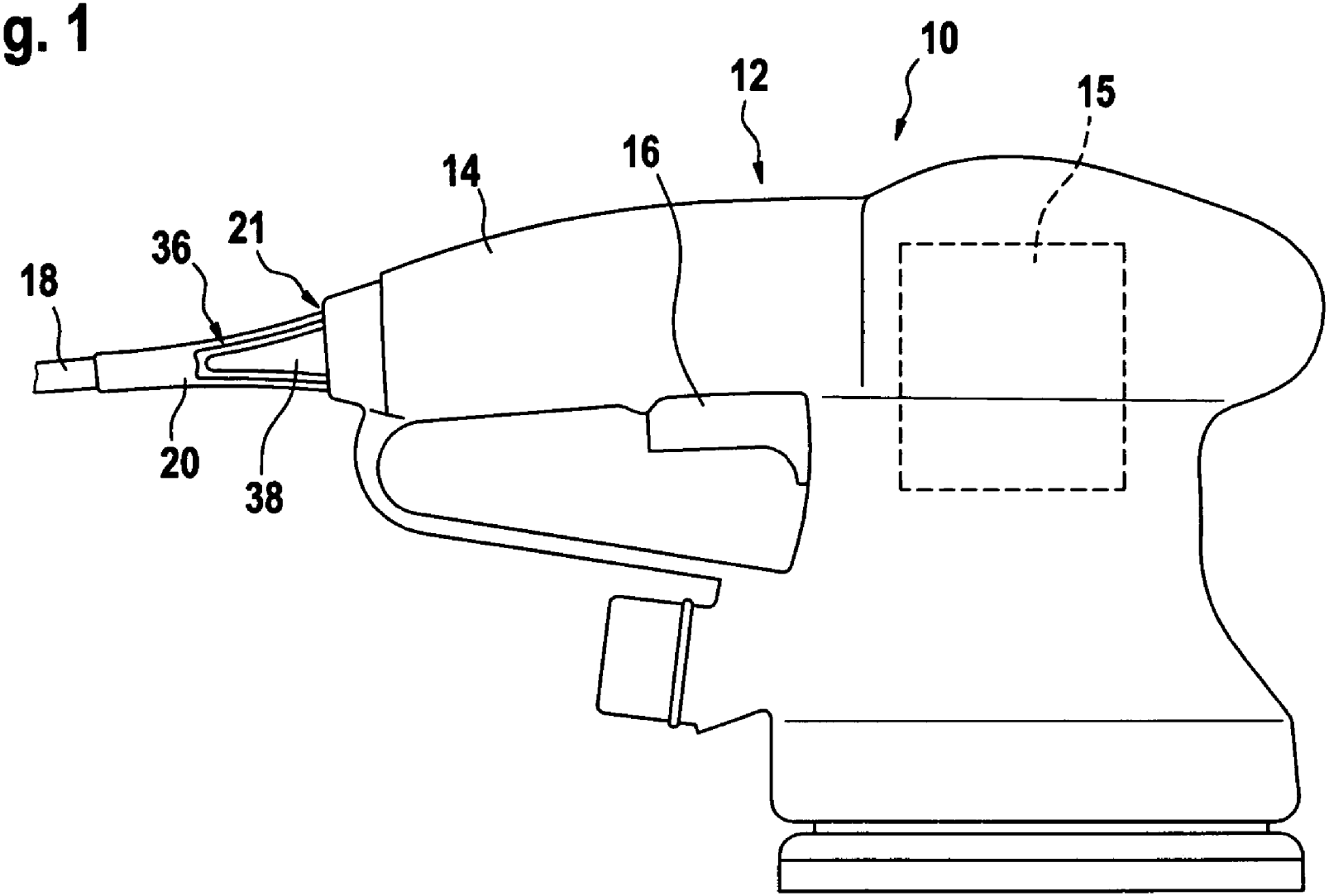
FIG. 1 shows a hand power tool with the cord sleeve in accordance with the present invention.

FIG. 1 shows a side view of an electric hand power tool 10, which is designed as an oscillating grinder. It has a housing 12, which at the back—pointing to the left in the viewing direction—has a handle 14. A pushbutton switch 16 for switching a motor 15 on and off extends from the underside of the tool. The motor is connected to a voltage source via a power cord 18 and is intended for driving a grinding wheel, not further shown.

Figure 4:
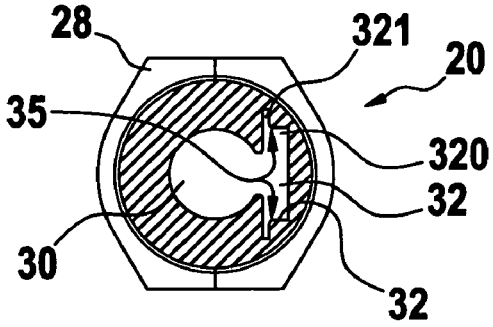
FIG. 4 is an enlarged view of the face end of the cord sleeve in accordance with the present invention.

The power cord 18 extends to the outside from the handle 14 at the back and is tubularly clasped in its exit region by a cord sleeve 20. The cord sleeve 20 has a lateral bulge 36, past which a tongue 38 extends. The bulge 36 includes a longitudinally extending double slot 32 (FIGS. 2, 4), which serves as a pocket for receiving a data tape 34 (FIG. 5) and which on the front end 24 comprises one short and one long slot 320, 321 (FIGS. 2, 4).

Figure 2:
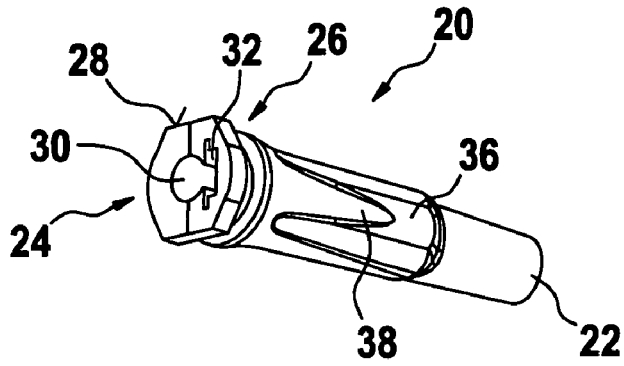
FIG. 2 shows the cord sleeve in accordance with the present invention by itself obliquely from the front.

FIG. 2 shows the detail of the cord sleeve 20 as a three-dimensional view looking toward its front end 24, whose face end is designed as a radial tab 28 and is penetrated by a central round longitudinal hole, through which—once the electric hand power tool 10 has been completely assembled—the power cord 18 passes.

The face-end radial tab 28 is adjoined at the back by a waistlike annular groove 26, with which the cord sleeve 20 is fitted into the annular exit opening 21 at the rear end of the handle 14 and is firmly held by form-locking.

Axially parallel to the rear in the viewing direction, the cord sleeve 20 has the lateral radial basket-shaped bulge 36, whose wall surrounds the double slot 32 and forms a pocket. The face-end radial tab 28 has the opening of the double slot 32 with the short slot 320 and the long slot 321, which merge with one another, extending parallel, and describe a flat, hat-shaped contour in the radial tab 28. The short slot 320, in its rearward course, extends with approximately the same width as the long slot 321, so that at the transition between the short slot 320 and the long slot 321, the radial tab 28 forms two corner lips 35.

From the annular groove 26, a tongue 38 extends over the top side of the bulge 36; this tongue strengthens and reinforces the top side of the bulge 36 and is capable of absorbing strong bending moments.

Figure 3:
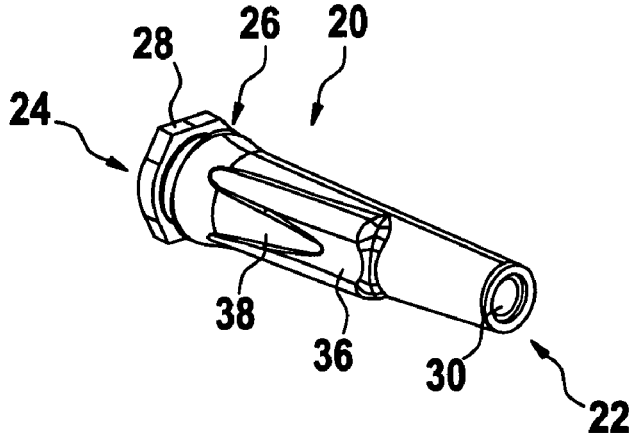
FIG. 3 shows the cord sleeve in accordance with the present invention by itself obliquely from the back.

FIG. 3 shows the back view of the cord sleeve 20, with the details already mentioned in conjunction with FIG. 2; the basket-shaped design of the bulge 36 and the annular groove 26 are especially clearly visible.

FIG. 4, in a top view on the radial tab 28, shows the special design and hat-like cross section of the long slot 32 designed as a double slot. It is composed of the longer but narrower long slot 321 and the shorter but wider short slot 320, which merge with one another and thus form the hat-like contour with the two corner lips 35.

Figure 5:
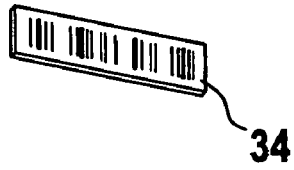
FIG. 5 shows a data storage medium of the cord sleeve in accordance with the present invention by itself.

FIG. 5 is a schematic illustration of a data storage medium 34. It has a bar code, not shown in detail, and comprises thin, flexible, resistant material and can easily be introduced, as a sufficiently bending-resistant body, into the double slot 32. The data storage medium 34 may for instance comprise a plastic film or a plastic woven or knitted fabric.

The data storage medium 34 is as wide as the wide slot 321 is long, slightly thicker than that slot is wide, and somewhat shorter than the length of the double slot 32.

If the data storage medium 34 is introduced into the wide slot 321, its face end can disappear behind the short slot 23 and the corner lips 35 and is thus simultaneously secured against coming out unintentionally.

Once the cord sleeve 20 is secured to the housing 12 in the intended installed position, the data storage medium 34 is firmly held in the cord sleeve 20 both by the constriction effect at the annular groove 26 and in force-locking fashion.

It will be understood that each of the elements described above, or two or more together, may also find a useful application in other types of constructions differing from the types described above.

While the invention has been illustrated and described as embodied in a cord sleeve and device provided therewith, it is not intended to be limited to the details shown, since various modifications and structural changes may be made without departing in any way from the spirit of the present invention.

Without further analysis, the foregoing will reveal fully revela the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims.

The invention claimed is:

1. An electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium, wherein said means for receiving the data storage medium is formed so that the data storage medium is seated in said cord sleeve in such a way that it is not visible.

2. An electric hand power tool as defined in claim 1, wherein said cord sleeve is locked in form-locking fashion in said housing.

3. An electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium, wherein said means for receiving the data storage medium is formed so that the data storage medium is seated in said cord sleeve in such a way that it is not visible from outside.

4. An electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium, wherein said means is formed so that the data storage medium, once said cord sleeve has been installed on said housing, can not be removed from said cord sleeve non destructively.

5. An electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium, wherein said means include a longitudinally extending double slot which is formed in said cord sleeve and passes through a front end of said cord sleeve so as to act as a pocket which extends parallel to said power cord and into which the data storage medium is placeable in a captive fashion before said cord sleeve is installed on the hand power tool.

6. An electric hand power tool as defined in claim 5, wherein said double slot is formed so that the data storage medium is holdable firmly in said double slot in a manner selected from the group consisting of a force-locking fashion, a form-locking fashion, and both.

7. An electric hand power tool as defined in claim 5, wherein said means include surface adhesive means located in an interior of said pocket and firmly holding the data storage medium detachably therein.

8. An electric hand power tool as defined in claim 7, wherein said surface adhesive means are selected from the group consisting of adhesives and hook-n-loop closure systems.

9. An electric hand power tool as defined in claim 5, wherein said double slot has a longitudinal hole with parallel long and short slots which merges one another and downstreamly which the data storage medium, after passing through said long and short slots, is located in captive fashion concealed from view.

10. An electric hand power tool as defined in claim 9, wherein said double slot forms two corner lips in a radial tab in a contour between said long and short slots, with lips provided downstream and positionally securing the data storage medium in a way that is braceable in form-locking fashion.

11. An electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium, wherein said cord sleeve comprises a material in which, in a way not visible from outside, data are storable in a manner selected from the group consisting of magnetically and thermally.

12. An electric hand power tool as defined in claim 11, wherein said cord sleeve is composed of the material in which data are storable in a rewritable way.

13. An electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium, wherein said cord sleeve has a radial basket-shaped hollow bulge with an interior for stowing data of the storage medium.

14. An electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium, wherein the data storage medium is elastically bendable.

15. An electric hand power tool, comprising a housing; a drive motor; a power cord extending to an outside from said housing and supplying energy to said drive motor, said power cord having an exit region with a cord sleeve that tubularly clasps said power cord, said cord sleeve being provided with means for receiving a data storage medium, wherein the data storage medium is integrated with said cord sleeve.

* * * * *